US006216818B1

(12) United States Patent
Moffat

(10) Patent No.: US 6,216,818 B1
(45) Date of Patent: Apr. 17, 2001

(54) MOBILE LADDER INCLUDING A GOODS LIFT

(75) Inventor: William Moffat, Flynn (AU)

(73) Assignee: Custom Ladder Company, Pty. Ltd., New South Wales (AU)

( * ) Notice: Subject to any disclaimer, the term of this patent is extended or adjusted under 35 U.S.C. 154(b) by 0 days.

(21) Appl. No.: 09/284,924

(22) PCT Filed: Oct. 22, 1997

(86) PCT No.: PCT/AU97/00707

§ 371 Date: Apr. 23, 1999

§ 102(e) Date: Apr. 23, 1999

(87) PCT Pub. No.: WO98/17890

PCT Pub. Date: Apr. 30, 1998

(30) Foreign Application Priority Data

Oct. 24, 1996 (AU) ..... PO 3202

(51) Int. Cl.[7] ..... E06C 5/00
(52) U.S. Cl. ..... 182/17; 182/103
(58) Field of Search ..... 182/15–17, 129, 182/103

(56) References Cited

U.S. PATENT DOCUMENTS

| | | | | |
|---|---|---|---|---|
| 1,606,601 | | 11/1926 | Rosenberg . | |
| 1,924,751 | | 8/1933 | Porter | 227/12 |
| 2,109,196 | | 2/1938 | Honig | 227/8 |
| 2,479,736 | * | 8/1949 | Fieroh | 182/17 |
| 2,624,590 | * | 1/1953 | Tilton | 182/17 |
| 2,626,683 | | 1/1953 | Eppink | 187/10 |
| 2,798,652 | * | 7/1957 | Easton | 182/17 |
| 3,155,190 | * | 11/1964 | Borgman | 182/15 |
| 3,206,003 | | 9/1965 | Orr | 198/126 |
| 3,232,377 | * | 2/1966 | Smith | 182/17 |
| 3,490,558 | | 1/1970 | Foley | 182/103 |
| 3,664,458 | * | 5/1972 | Sterns | 182/102 |
| 3,684,055 | * | 8/1972 | Rice | 182/17 |
| 5,628,522 | | 5/1997 | Hall | 280/43.17 |

FOREIGN PATENT DOCUMENTS

| | | | |
|---|---|---|---|
| 74098/74 | 4/1976 | (AU) | E06C/7/16 |
| 223170 | 11/1942 | (CH) . | |
| 871 693 | 3/1953 | (DE) . | |
| 29 24 543 C2 | 8/1981 | (DE) | E06C/7/12 |
| 2171571 | 8/1973 | (FR) | E06C/5/00 |
| 1 442 550 | 5/1974 | (GB) | B66F/11/04 |
| 08333975 | 12/1996 | (JP) | E06C/5/20 |
| 09112022 | 4/1997 | (JP) | E04F/19/08 |

* cited by examiner

*Primary Examiner*—Alvin Chin-Shue
(74) *Attorney, Agent, or Firm*—Heslin & Rothenberg, P.C.

(57) ABSTRACT

A mobile ladder (10) including a goods lift (12) which can be driven between upper (FIG. 3) and lower (FIG. 4) positions. The ladder has a default-immobile state which can be overcome by a force manually applied to a handle. The ladder can then be moved and steered via the handle.

1 Claim, 3 Drawing Sheets

MOBILE LADDER INCLUDING A GOODS LIFT

TECHNICAL FIELD

This invention relates to a mobile ladder including a goods lift.

BACKGROUND ART

There is a growing awareness of issues relating to occupational health and safety. One area of concern which has not been adequately addressed is the retrieval or placement of goods in elevated shelving. This often involves a large amount of biomechanically incorrect lifting and the carrying of goods up and down ladders.

DISCLOSURE OF INVENTION

This invention in one aspect resides in a mobile ladder including:

a goods lift moveable between an upper position at which goods on the goods lift can be accessed by a person on the ladder and a lower position at which goods on the goods lift can be accessed by a person on the ground; and driving means for driving the goods lift between the upper and lower positions.

The goods lift may be mounted in any manner however it is preferred that the goods lift is mounted for vertical movement on a fixed guide frame.

Preferably, the driving means includes a hand-driven winch or electric motor, however any other driving means may be used. A brake winch is highly preferred due to its simplicity of use. In one embodiment, electrical or other control of the driving means is provided at both the top of the ladder and bottom of the ladder. Thus, the driving means can be operated by the operator whilst standing at the base of the ladder or whilst on the ladder.

In a highly preferred embodiment, the mobile ladder is a "default immobile" ladder including means for rendering the ladder mobile, i.e. in the absence of a mobilising force, the ladder is immobile. A default mobile ladder is disclosed in the present applicant's International Application PCT/AU96/00672 and the disclosure of that application is incorporated by cross-reference. Preferably, the default immobile ladder includes handle means which can be manually grasped to both mobilise the ladder and thereafter steer the ladder. When the handle is released the ladder returns to the default immobile position.

BRIEF DESCRIPTION OF DRAWINGS

In order that this invention may be more easily understood and put into practical effect, reference will now be made to the accompanying drawings which illustrate preferred embodiments of the invention, wherein.

BEST MODE

With reference to the FIGS there are illustrated two embodiments of mobile ladders having wheels or castors which are vertically displaceable to selectively render the ladder mobile. The mechanism used to displace the castors to thereby render the ladder mobile is disclosed in detail in International Application PCT/AU96/00672 referred to above, although other mechanisms, such as for example is disclosed in French Patent 2,171,571, may be used. As noted below, the configuration of the handle is particularly advantaeous in terms of pushing and steering the ladder.

Ladder 10 includes a goods lift 12 which is guided for substantially vertical sliding movement on guide frame 14.

Drive means, in the form of a hand winch 16 and cable 18, is used to displace goods lift 12 between the upper and lower positions.

Figure 1:
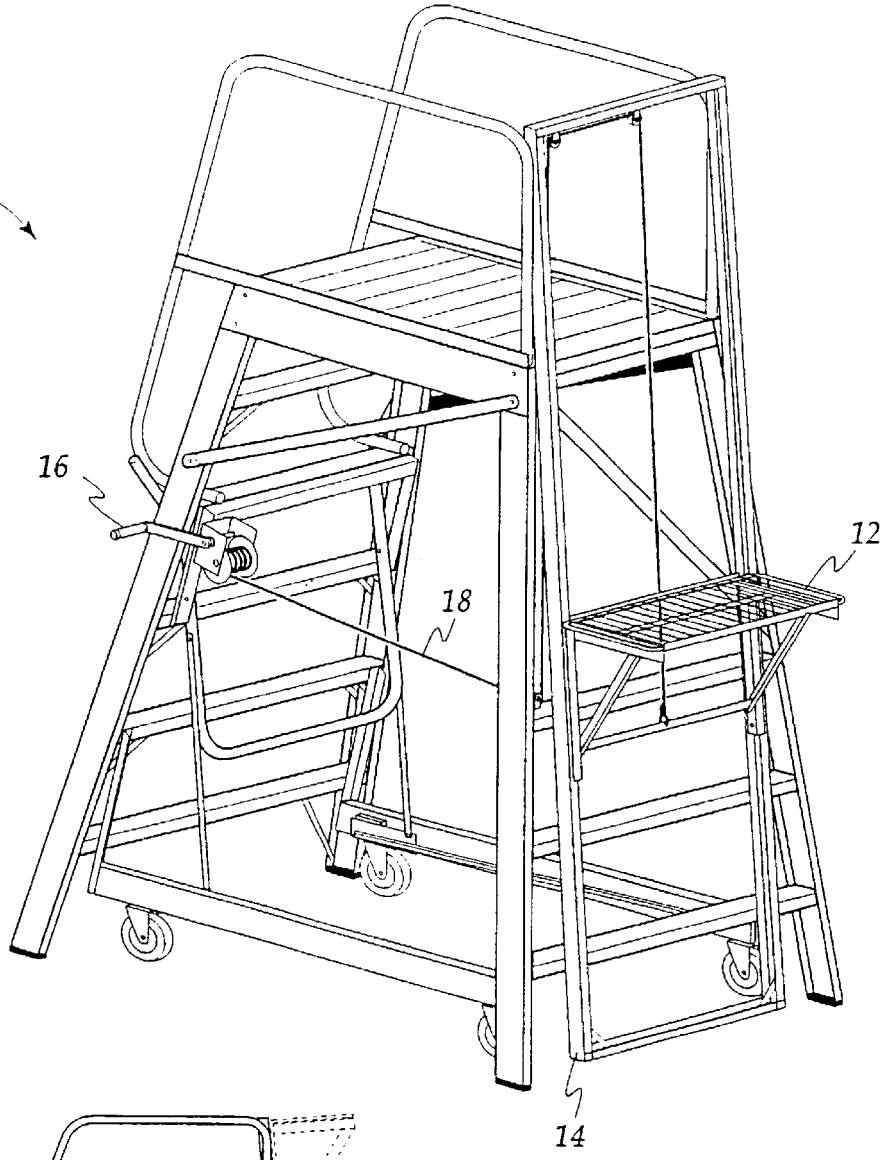
FIG. 1 is a perspective view of a ladder according to the invention.
Figure 2:
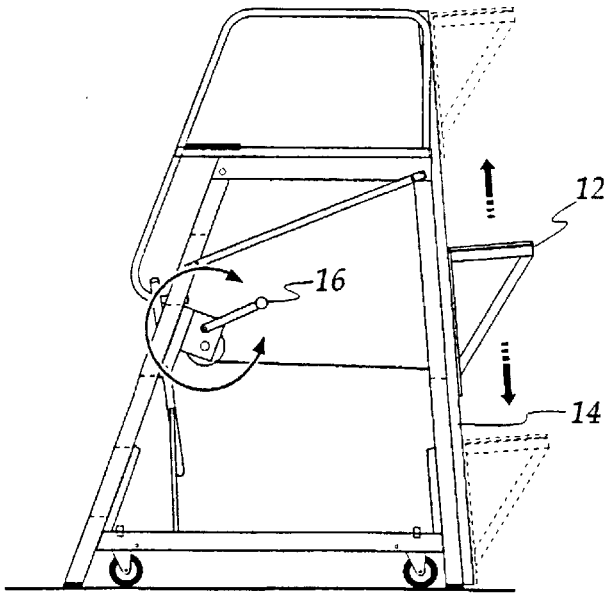
FIG. 2 is a side elevation of the ladder of FIG. 1.
Figure 3:
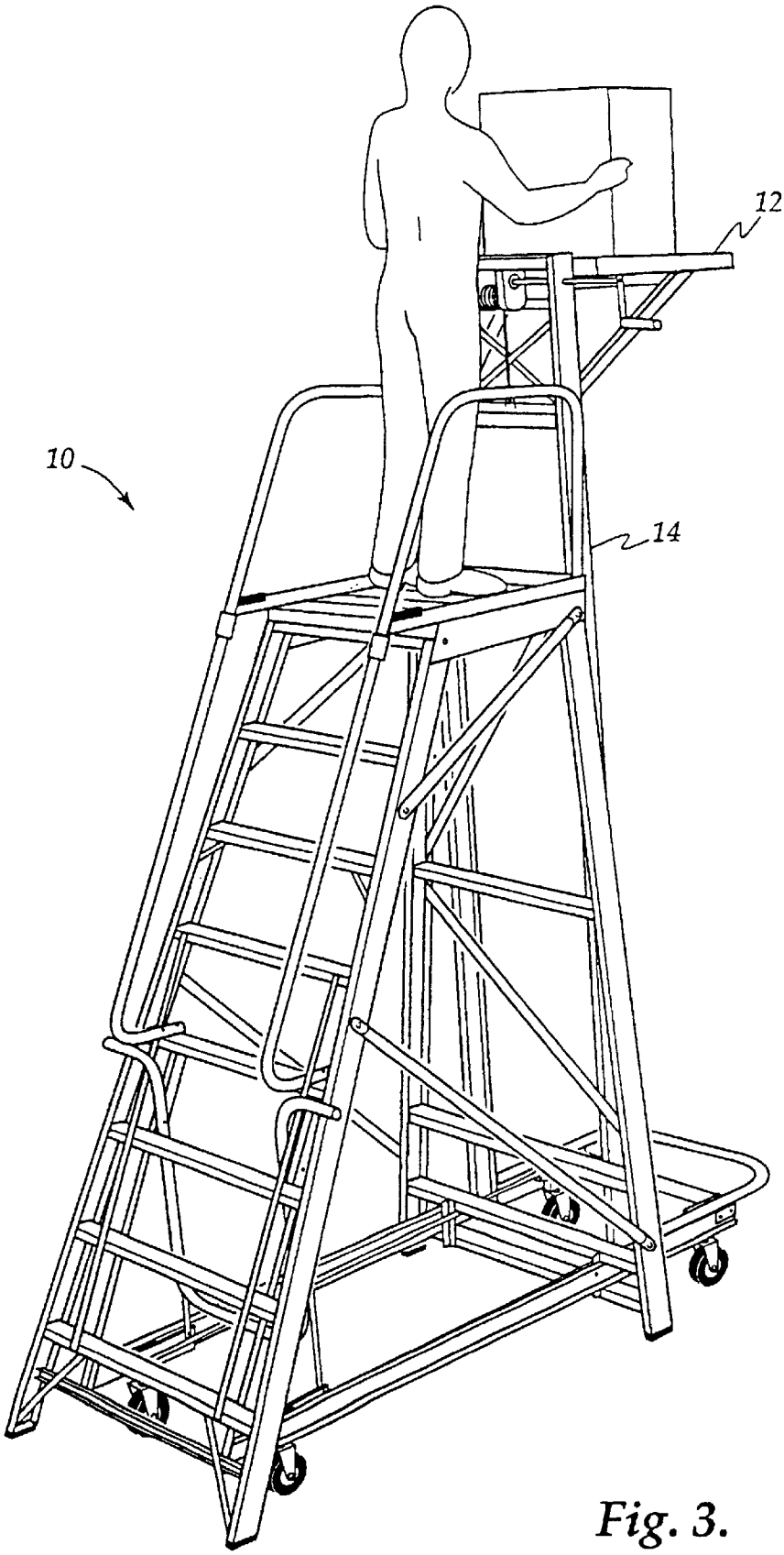
FIG. 3 is a schematic perspective view of a ladder according to the invention with the goods lift in its uppermost position.
Figure 4:
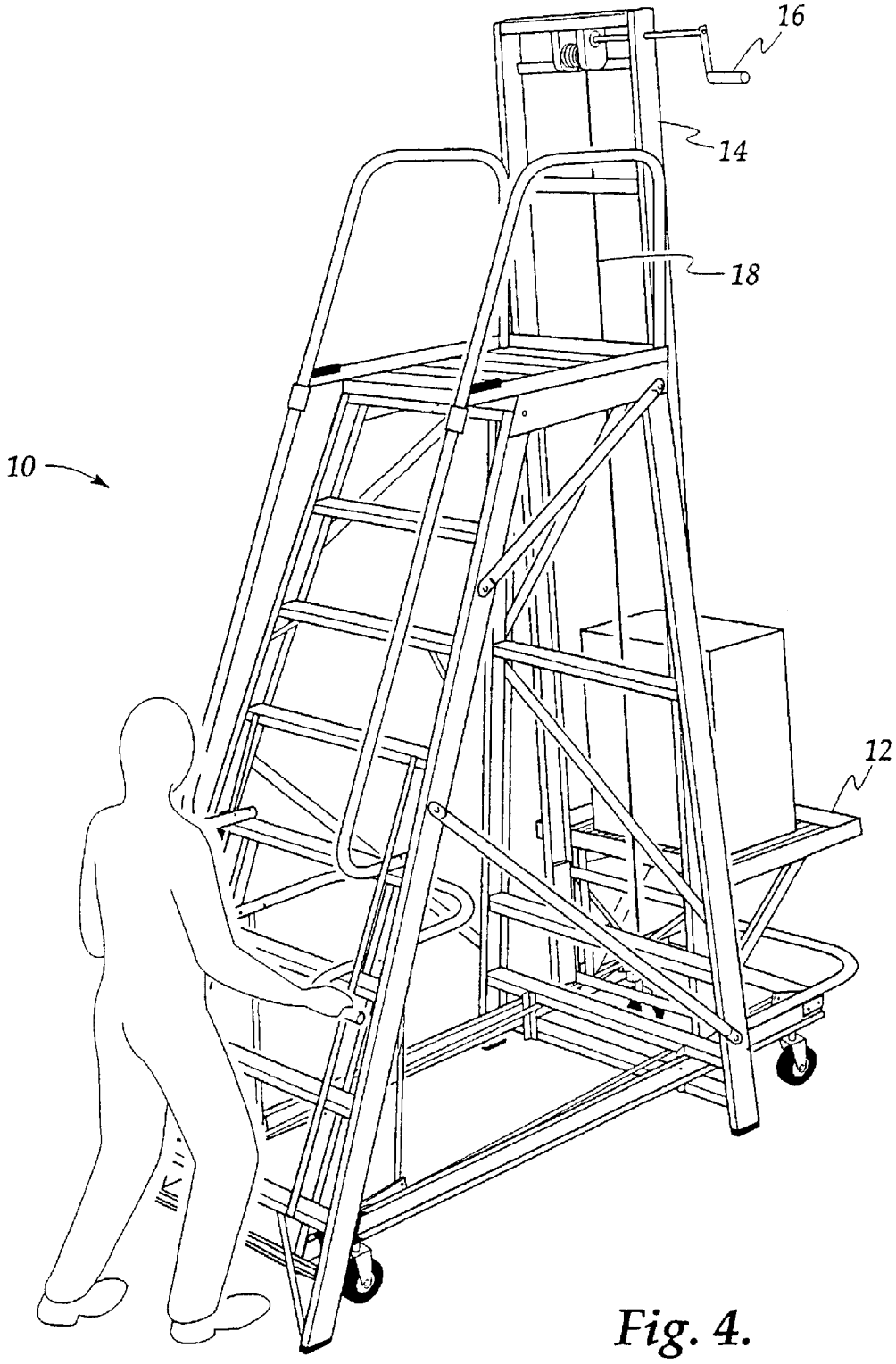
FIG. 4 is a schematic perspective view of the ladder of FIG. 3 with the goods lift in its lowermost position.

With reference, to FIGS. 3 and 4, it will be noted that the wheelbase of the ladder has been extended beyond the feet of the ladder for reasons of stability.

With reference to FIG. 4, it will be noted that the operator has pivoted the handle to the operative position thereby mobilising the ladder and providing an ergonomic means by which the ladder and store can be moved to another position. As can be seen, the handle advantageously includes a pair of horizontally spaced levers, each of which is grasped by a hand. The ladder can thus be easily steered by the operator. When the operator releases the handle, the ladder returns to the default immobile position and the handle pivots back under gravity to the stowed position shown in FIG. 3.

In use, a store can be retrieved from shelving as follows. The operator moves the ladder to the desired location and ascends the ladder. The operator retrieves the good from the shelf, and it is placed or slid onto the goods lift 12 which is conveniently aligned with the level of the shelf. The operator then drives the goods lift (and good) to a lower position from which it can be easily retrieved from the ground. The good can then be removed from the goods lift by the operator or, if it needs to be delivered to another location, the ladder can be made mobile and wheeled to the desired location at which the good can then be removed.

The reverse operation is, of course, applicable when placing goods in shelving.

The present invention provides a ladder in which the dangerous practice of carrying loads up and down ladders is eliminated. Furthermore, the ladder can be used in a trolley-like manner to transport goods.

The goods lift 12 can be fixed at any height and, accordingly, the goods lift can be fixed at a height corresponding to the shelf height and goods can be horizontally slid directly onto the goods lift rather than lifted between the shelf and goods lift. Similarly, when removing goods from the goods lift, the goods lift can be convenienly vertically aligned with the recipient surface so that, again, no lifting is required. This also minimises the likelihood of goods being dropped and damaged.

It will of course be realised that whilst the above has been given by way of an illustrative example of this invention, all such and other modifications and variations hereto, as would be apparent to persons skilled in the art, are deemed to fall within the broad scope and ambit of this invention as is herein set forth.

What is claimed is:

1. A ladder which can be selectively actuated by a user between a default fully-immobile mode and an actuated fully-mobile mode, said ladder comprising:

opposed first and second ladder frames jointly defining a wheel base having four feet which are normally in contact with the ground surface, four castors which can be selectively and simultaneously urged downwardly beyond the four feet so that the four feet are raised clear of the ground surface, wherein discontinuation of the selective downward urging of the four castors automatically causes the four feet to re-engage the ground surface under the effect of gravity such that the ladder reverts to its default fully-immobile mode, wherein a fixed height platform extends between the opposed first and second ladder frames, said fixed height platform being sized to accommodate a standing person, wherein the second ladder frame extends upwardly beyond the height of the fixed height platform, and wherein a readily movable goods lift is mounted relative to the second ladder frame for movement between an upper position located above the fixed height platform and adjacent the top of the second frame whereat a person standing on the fixed height platform can readily access the goods lift and a lower position below the fixed height platform whereat a person standing on the ground surface can readily access the goods lift, and wherein the ladder further comprises driving means for driving the goods lift between the upper position and lower position, said driving means being located so as to be operable by a person standing on the fixed height platform wherein the wheelbase of the ladder is extended beyond the second frame to improve the stability of the ladder.

* * * * *